US005984169A

United States Patent [19]

Detloff

[11] Patent Number: 5,984,169

[45] Date of Patent: Nov. 16, 1999

[54] PAPERBOARD BIN AND DIVIDERS FOR STORAGE AND ORGANIZATION OF PIECE PARTS AND SIMILAR ITEMS

[76] Inventor: Craig Detloff, 1208 Granvia Altamira, Palos Verdes Estates, Calif. 90274

[21] Appl. No.: 09/128,961

[22] Filed: Aug. 4, 1998

[51] Int. Cl.[6] ..... B65D 5/48

[52] U.S. Cl. ..... 229/120.38; 229/120.06; 229/164; 229/178; 229/913

[58] Field of Search ..... 229/120.06, 120.38, 229/164, 178, 913; 220/534, 543

[56] References Cited

U.S. PATENT DOCUMENTS

| | | | |
|---|---|---|---|
| 1,500,007 | 7/1924 | Sibbald | 220/543 |
| 1,770,681 | 7/1930 | Walter | 229/120.38 |
| 2,022,305 | 11/1935 | Wellman | 229/164 |
| 2,186,947 | 1/1940 | Zalkind | 220/543 |
| 3,288,348 | 11/1966 | Brackett | 229/120.06 |
| 3,784,083 | 1/1974 | Pfaffendorf et al. | 229/164 |
| 3,815,048 | 5/1965 | Stuble | 229/120.06 |
| 4,089,458 | 5/1978 | Meyers et al. | 229/120.06 |
| 4,120,443 | 10/1978 | Gardner et al. | 229/120.38 |
| 4,235,158 | 11/1980 | Johnson, Jr. | 229/120.38 |
| 4,396,115 | 8/1983 | Watson | 229/120.06 |
| 4,705,168 | 11/1987 | Ward | 220/534 |
| 5,395,049 | 3/1995 | Huhn | 220/543 |

FOREIGN PATENT DOCUMENTS

| | | | |
|---|---|---|---|
| 1227177 | 4/1971 | United Kingdom | 229/164 |

*Primary Examiner*—Gary E. Elkins
*Attorney, Agent, or Firm*—David A. Belasco; William H. Pavitt; Beehler & Pavitt

[57] ABSTRACT

A paperboard bin for storage and organization of piece parts and similar items is described. The bin is formed from a single piece of paperboard and may be rapidly assembled without the use of tools. The bin comprises an elongated rectangular bottom panel, first and second joined side panels, first and second rectangular outside end panels foldably joined to the bottom panel, first and second rectangular inside end panels foldably joined to the first and second rectangular outside end panels, first, second, third and fourth rectangular end reinforcing panels foldably joined to the first and second side panels and first and second detachable divider panels. The bottom panel includes a pair of tab element receiving slots. The first and second inside end panels each include a bendable tab element sized, shaped and disposed to engage the tab element receiving slots in the bottom panel. The side panels are folded inwardly from the bottom panel, the rectangular end reinforcing panels are folded inwardly from the side panels and the outside end panels are folded inwardly from the bottom panel. The inside end panels are folded inwardly from the outside end panels and over the end reinforcing panels with the bendable tab elements engaging the tab element receiving slots in the bottom panel, thereby forming an open topped bin. The detachable divider panels include a center section and a pair of end flaps. The end flaps are folded inwardly from the center section and the divider panels are inserted into the bin with the end flaps bearing on the side panels of the bin to form up to three compartments within the bin of varying volume. The divider panels may be perforated longitudinally to yield smaller divider panels of reduced height to more clearly display the contents of the bin.

10 Claims, 2 Drawing Sheets

PAPERBOARD BIN AND DIVIDERS FOR STORAGE AND ORGANIZATION OF PIECE PARTS AND SIMILAR ITEMS

FIELD OF INVENTION

The invention pertains to a paperboard box construction. More particularly, the invention relates to a bin box construction adapted for storage and organization of small piece parts of one, two or three varieties that may occur in various quantities and thus movable dividers for the bin box.

BACKGROUND OF THE INVENTION

Various types of paperboard boxes, bins and trays have been devised to store and organize piece parts and other small items.

U.S. Pat. No. 2,462,676, issued to Riley et al. is directed to a fiberboard carton cut from a substantially rectangular blank that can be shipped flat. In use partition blanks are separated from the main blank, which is folded to form a carton, and the partitions are installed to separate up to twelve bottles. U.S. Pat. No. 519,005, issued to Reeves discloses a box and partition made from one piece of cardboard or similar material with the blank separated into the box portion and the divider portions. The dividers interlock to form twelve rectangular compartments. U.S. Pat. No. 3,977,592, issued to Gorham, describes a one-piece die cut carton blank that incorporates four cell divider panels formed integrally with the blank. U.S. Pat. No. 4,396,115, issued to Watson, illustrates a novel blank of foldable sheet material such as paperboard which is cut and scored to provide a carton forming section and an integral partition forming section detachably connected to each other.

An effective design for a bin for piece parts and similar items must necessarily be a compromise of various factors. It is an objective of the present invention that the parts bin provides the ability to segregate different parts within the same bin. It is a further objective that the parts bin have compartments that can be varied in size to make maximum use of the space available when differing quantities of different types of parts are to be organized. It is yet a further objective of the invention that the parts bin is economical to produce and simple to assemble. It is a still further objective that the parts bin can be formed from a single piece of paperboard.

While features disclosed in the prior art satisfy some of the objectives of the present invention, none of the inventions found include all of the requirements identified.

SUMMARY OF THE INVENTION

The present invention addresses all of the deficiencies of prior art parts bins and trays and satisfies all of the objectives described above. A paperboard bin and dividers for storage and organization of piece parts and similar items may be formed from a single blank of paperboard material comprising the following components. A rectangular bottom panel is provided having first and second elongated, opposed parallel side edges and third and fourth opposed parallel end edges of a first predetermined length and normal to the first and second edges.

First and second tab element receiving slots are located along the third and fourth edges of the bottom panel. First and second side panels are provided, each having first and second elongated, opposed parallel side edges and third and fourth opposed parallel end edges, one of which is of a second predetermined length normal to the first and second edges of the side panel. The first side panel is foldably joined at its first edge to the first edge of the bottom panel and the second side panel is foldably joined at its first edge to the second edge of the bottom panel.

First and second rectangular outside end panels are provided, each having first and second, opposed parallel edges of the first predetermined length and third and fourth opposed parallel edges, one of which is of the second predetermined length, normal to the first and second edges. The first outside end panel is foldably joined at its first edge to the third edge of the bottom panel and the second outside end panel is foldably joined at its first edge to the fourth edge of the bottom panel.

First and second rectangular inside end panels are provided, each having first and second, opposed parallel edges of the first predetermined length and third and fourth opposed parallel edges, one of which is of the second predetermined length, normal to the first and second edges. First and second bendable tab elements, are located along the second edges of the first and second inside end panels and sized, shaped, and disposed to engage the tab element receiving slots of the bottom panel. The first inside end panel is foldably joined at its first edge to the second edge of the first outside end panel and the second inside end panel is foldably joined at its first edge to the second edge of the second outside end panel.

First, second, third and fourth rectangular end reinforcing panels are provided, each having a pair of first and second elongated, opposed parallel edges two of which are of the second predetermined length and third and fourth opposed parallel edges normal to the first and second edges. Each of the first and second end reinforcing panels is foldably joined at its first edge to one of the third edges of the first and second side panels. Each of the third and fourth end reinforcing panels is foldably joined at its first edge to one of the fourth edges of the first and second side panels.

First and second rectangular divider panels are provided, each having first and second elongated, opposed parallel edges and third and fourth opposed parallel edges normal to the first and second edges. Each of the first and second divider panels is detachably joined at its first edge to one of the second edges of the third and fourth end reinforcing panels by means of first and second perforations.

Each of the first and second divider panels include a rectangular center section having first and second, opposed parallel edges of the first predetermined length and third and fourth opposed parallel edges of the second predetermined length normal to the first and second edges.

The divider panels also include first and second rectangular end flaps. Each of the first and second end flaps has first and second, opposed parallel edges of the second predetermined length and third and fourth opposed parallel edges normal to the first and second edges. Each of the first and second end flaps is foldably joined at its first edge to the third and fourth edges of the center section of the first and second divider panels.

To assemble the bin, the first and second divider panels are detached from the third and fourth end reinforcing panels. Next, the first, second, third and fourth end reinforcing panels are folded inwardly from the first and second side panels and the first and second side panels are folded inwardly from the bottom panel. Next, the first and second outside end panels are folded inwardly from the bottom panel and the first and second inside end panels are folded inwardly from and over the first and second outside end panels to enclose the first, second, third and fourth end reinforcing panels. Then, the first and second bendable tab elements are disposed to engage the first and second tab element receiving slots to form an open-topped bin.

To insert the movable divider panels, the first and second end flaps of the first and second divider panels are folded inwardly from the center section of the divider panels and the first and second dividers are inserted into the bin. The first and second end flaps will be urged outwardly from the center section to bear against the first and second side panels of the bin, thereby providing up to three compartments within the parts bin of adjustable volume.

In variation of the invention, the bin with equal height ends and its dividers may be formed from a one-piece, planar, paperboard blank.

In another variation of the invention the third and fourth edges of the first inside end panel and the first outside end panel have a third predetermined length that is less than the second predetermined length. The first and second edges of the first and second end reinforcing panels are also of the third predetermined length.

The third edge of the first and second side panels includes a lower portion of the third predetermined length and an upper angled portion. The lower portion is parallel to the fourth edge of the first and second side panels and has a first end located at the first edge of each of the side panels. The lower portion of the third edge of the first and second side panels has an opposite second end. The upper angled portion extends from the second end of the lower portion to a point along the second edge of each of the first and second side panels.

When the bin is formed, it will have a first end having a height equal to the second predetermined length and a second end having a height equal to the third predetermined length, thereby providing easy access to the bin.

In yet another variation of the invention, the bin with unequal length ends and its dividers may be formed from a one-piece, planar, paperboard blank.

In a final variation of the invention at least one of the first and second rectangular divider panels includes a third perforation. The third perforation extends from the divider panel's first edge to its second edge, the third perforation being spaced between the third edge and the fourth edge of the divider panel, thereby permitting the divider panel to be separated into two smaller divider panels of reduced height.

When the divider panel is separated into two smaller divider panels, the smaller panels may be used to more clearly display the contents of the bin.

DETAILED DESCRIPTION OF THE PREFERRED EMBODIMENT

Figure 1:
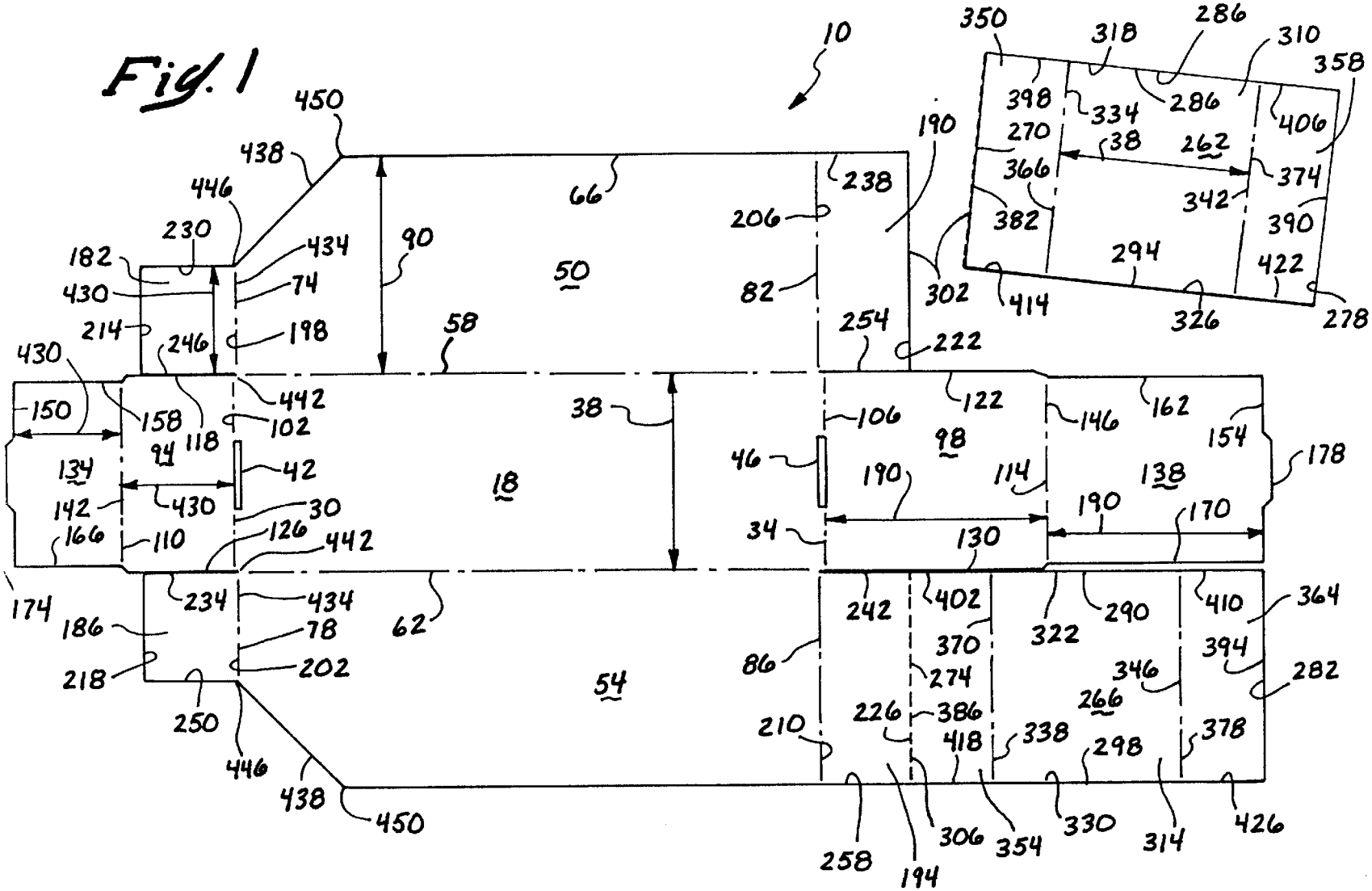
FIG. 1 is a plan view of the preferred embodiment of the invention illustrating the detachable divider panels.
Figure 4:
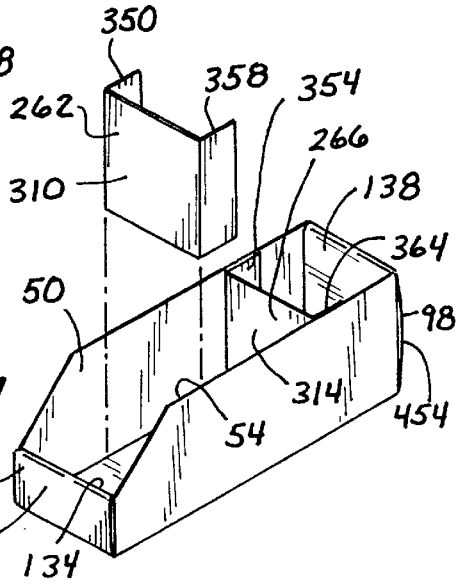
FIG. 4 is a perspective view of FIG. 1 illustrating the assembled bin with the first and second divider panels.

FIGS. 1 and 4 illustrate a paperboard bin and dividers 10 for storage and organization of piece parts and similar items that may be formed from a single blank 14 of paperboard material comprising the following components. A rectangular bottom panel 18 is provided having first 22 and second 26 elongated, opposed parallel side edges and third 30 and fourth 34 opposed parallel end edges of a first predetermined length 38 and normal to the first 22 and second 26 edges.

First 42 and second 46 tab element receiving slots are located along the third 30 and fourth 34 edges of the bottom panel 18. First 50 and second 54 side panels are provided, each having first 58, 62 and second 66, 70 elongated, opposed parallel side edges and third 74, 78 and fourth 82, 86 opposed parallel end edges, one of which is of a second predetermined length 90, normal to the first 58, 62 and second 66, 70 edges of the first 50 and second 54 side panels. The first side panel 50 is foldably joined at its first edge 58 to the first edge 22 of the bottom panel 18 and the second side panel 54 is foldably joined at its first edge 62 to the second edge 26 of the bottom panel 18.

First 94 and second 98 rectangular outside end panels are provided, each having first 102, 106 and second 110, 114, opposed parallel edges of the first predetermined length 38 and third 118, 122 and fourth 126, 130 opposed parallel edges, one of which having the second predetermined length 90, normal to the first 102, 106 and second edges 110, 11. The first outside end panel 94 is foldably joined at its first edge 102 to the third edge 30 of the bottom panel 18 and the second outside end panel 98 is foldably joined at its first edge 106 to the fourth edge 34 of the bottom panel 18.

First 134 and second 138 rectangular inside end panels are provided, each having first 142, 146 and second 150, 154, opposed parallel edges of the first predetermined length 38 and third 158, 162 and fourth 166, 170 opposed parallel edges, one of which having the second predetermined length 90, normal to the first 142, 146 and second edges 150, 154. First 174 and second 178 bendable tab elements, are located along the second edges 150, 154 of the first 134 and second 138 inside end panels and sized, shaped, and disposed to engage the first 42 and second 46 tab element receiving slots of the bottom panel 18. The first inside end panel 134 is foldably joined at its first edge 142 to the second edge 110 of the first 94 outside end panel and the second inside end panel 138 is foldably joined at its first edge 146 to the second edge 114 of the second 98 outside end panel.

First 182, second 186, third 190 and fourth 194 rectangular end reinforcing panels are provided, each having a pair of first 198, 202, 206, 210 and second 214, 218, 222, 226 elongated, opposed parallel edges two pairs of which are of the second predetermined length 90 and third 230, 234, 238, 242 and fourth 246, 250, 254, 258 opposed parallel edges normal to the first 198, 202, 206, 210 and second 214, 218, 222, 226 edges. Each of the first 182 and second 186 end reinforcing panels is foldably joined at its first 198, 202 edge to one of the third 74, 78 edges of the first 50 and second 54 side panels. Each of the third 190 and fourth 194 end reinforcing panels is foldably joined at its first 206, 210 edge to one of the fourth 82, 86 edges of the first 50 and second 54 side panels.

First 262 and second 266 rectangular divider panels are provided, each having first 270, 274 and second 278, 282 elongated, opposed parallel edges and third 286, 290 and fourth 294, 298 opposed parallel edges normal to the first 270, 274 and second 278, 282 edges. Each of the first 262 and second 266 divider panels is detachably joined at its first 270, 274 edge to one of the second 222, 226 edges of the third 190 and fourth 194 end reinforcing panels by means of first 302 and second 306 perforations.

Each of the first 262 and second 266 divider panels include a rectangular center section 310, 314 having first 318, 322 and second 326, 330, opposed parallel edges of the first predetermined length 38 and third 334, 338 and fourth 342, 346 opposed parallel edges of the second predetermined length 90 normal to the first 318, 322 and second 326, 330 edges.

The divider panels 262, 266 also include first 350, 354 and second 358, 364 rectangular end flaps. Each of the first 350, 354 and second 358, 364 end flaps has first 366, 370, 374, 378 and second 382, 386, 390, 394, opposed parallel edges of the second predetermined length 90 and third 398, 402. 406, 410 and fourth 414, 418, 422, 426 opposed parallel edges normal to the first 366, 370, 374, 378 and second 382. 386, 390, 394 edges. Each of the first 350, 354 and second 358, 364 end flaps is foldably joined at its first 366, 370, 374, 378 edge to the third 334, 338 and fourth 342, 346 edges of the center section 310, 314 of the first 262 and second 266 divider panels.

As shown in FIGS. 1–4, to assemble the bin 10, the first 262 and second 266 divider panels are detached from the third 190 and fourth 194 end reinforcing panels. Next, the first 182, second 186, third 190 and fourth 194 end reinforcing panels are folded inwardly from the first 50 and second 54 side panels and the first 50 and second 54 side panels are folded inwardly from the bottom panel 18. Next, the first 94 and second 98 outside end panels are folded inwardly from the bottom panel 18 and the first 134 and second 138 inside end panels are folded inwardly from and over the first 94 and second 98 outside end panels to enclose the first 182, second 186, third 190 and fourth 194 end reinforcing panels. Then, the first 174 and second 178 bendable tab elements are disposed to engage the first 42 and second 46 tab element receiving slots to form an open-topped bin 10.

To insert the movable divider panels 262, 266, the first 350, 354 and second 358, 364 end flaps of the first 262 and second 266 divider panels are folded inwardly from the center section 310, 314 of the divider panels 262, 266 and the first 262 and second 266 dividers are inserted into the bin 10. The first 350, 354 and second 358, 364 end flaps will be urged outwardly from the center sections 310, 314 to bear against the first 50 and second 54 side panels of the bin 10, thereby providing up to three compartments within the bin 10 of adjustable volume.

In variation of the invention, the bin 10 with equal height ends and its divider panels 262, 266 may be formed from a one-piece, planar, paperboard blank 14.

In another variation of the invention the third 158, 118, and fourth 166, 126, edges of the first 134 inside end panel and the first 94 outside end panel have a third predetermined length 430 that is less than the second predetermined length 90. The first 198, 202 and second 214, 218 edges of the first 182 and second 186 end reinforcing panels are also of the third predetermined length 430.

The third 74, 78 edge of the first 50 and second 54 side panels includes a lower portion 434 of the third predetermined length 430 and an upper angled portion 438. The lower portion 434 is parallel to the fourth 82, 86 edge of the first 50 and second 54 side panels and has a first 442 end located at the first 58, 62 edge of each of the side panels 50, 54. The lower portion 434 of the third edge 74, 78 of the first 50 and second 54 side panels has an opposite second end 446. The upper angled portion 438 extends from the second end 446 of the lower portion 434 to a point 450 along the second 66, 70 edge of each of the first 50 and second 54 side panels.

When the bin 10 is formed as shown in FIG. 4, it will have a first end 454 having a height equal to the second predetermined length 90 and a second end 458 having a height equal to the third predetermined length 430, thereby providing easy access to the bin 10.

In yet another variation of the invention, the bin 10 with unequal length ends and its dividers 262, 266 may be formed from a one-piece, planar, paperboard blank 14.

Figure 1A:
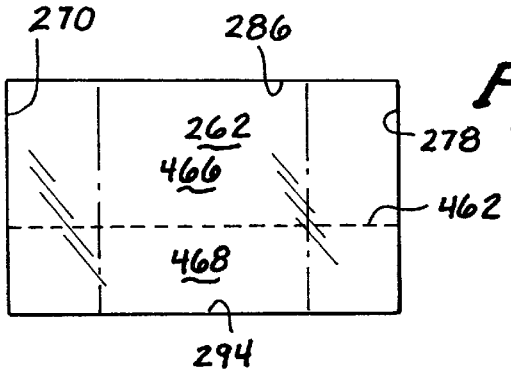
FIG. 1*a* is a plan view of a variant of the first divider panel illustrating a third perforation extending from its first edge to its second edge.
Figure 2:
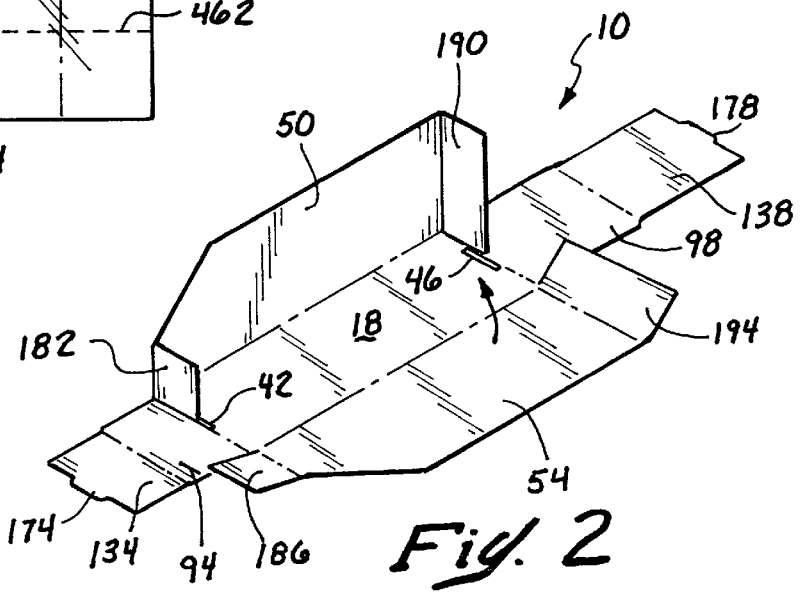
FIG. 2 is a perspective view of the FIG. 1 embodiment with the first side panel disposed orthogonally to the bottom panel and the first and third reinforcing end panels folded inwardly from the first side panel.
Figure 3:
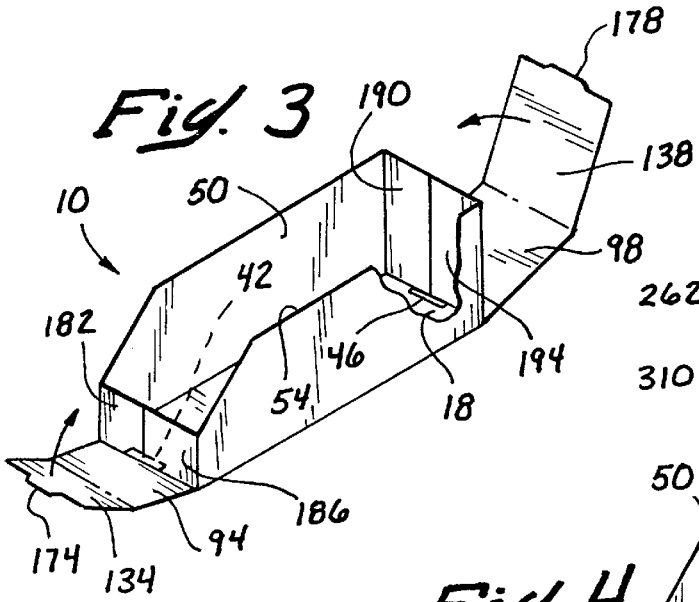
FIG. 3 is a perspective view of FIG. 1 embodiment with the first and second side panels disposed orthogonally to the bottom panel and the first, second, third and fourth reinforcing end panels folded inwardly from the first and second side panels and the first and second outside end panels folded inwardly from the bottom panel and the first and second inside end panels folded inwardly from the first and second inside end panels.

In a final variation of the invention, illustrated in FIG. 1*a*, at least one of the first 262 and second 266 rectangular divider panels includes a third perforation 462. The third perforation 462 extends from the divider panel's 262, 266 first edge 270, 274 to its second edge 278, 282, the third perforation 462 being spaced between the third edge 286, 290 and the fourth edge 294, 298 of the divider panel 262, 266, thereby permitting the divider panel 262, 266 to be separated into two smaller divider panels 466, 468 of reduced height.

When the divider panel 262, 266 is separated into two smaller divider panels 466, 468, the smaller panels 466, 468 may be used to more clearly display the contents of the bin 10.

A paperboard bin for storage and organization of piece parts and similar items 10 has been described with reference to particular embodiments. Other modifications and enhancements can be made without departing from the spirit and scope of the claims that follow.

I claim:

1. A bin for storage and organization of piece parts and similar items, formed of a rigid paper material, said bin comprising:

a rectangular bottom panel, said bottom panel having a first predetermined length and a first predetermined width;

first and second rectangular side panels, each of said side panels having the first predetermined length and a first predetermined height;

said first and second side panels being foldably joined to the bottom panel along their length and disposed orthogonally upward to the bottom panel;

first and second end panels, each of said end panels having the first predetermined width and the first predetermined height;

said first and second end panels being foldably joined to the bottom panel along their width and disposed orthogonally upward to the bottom panel;

means for removably attaching the first and second end panels to the first and second side panels, thereby forming with the bottom panel and the side panels an open top bin;

at least one rectangular divider panel, each of said divider panels having a rectangular center section having the first predetermined width, and a pair of rectangular end flaps, each of said end flaps being foldably joined to the center section and disposed orthogonally thereto and in slidable abutment with one of the first and second side panels; and whereby, the volume of the bin may be adjustably divided into different sized compartments.

2. A one-piece, planar, paperboard blank for forming the paperboard bin claim 1.

3. A bin for storage and organization of piece parts and similar items, formed of a rigid paper material, said bin comprising:

a rectangular bottom panel, said bottom panel having first and second elongated, opposed parallel side edges and third and fourth opposed parallel end edges, each end edge being of a first predetermined length and normal to the first and second edges;

first and second tab element receiving slots one being disposed along each of the third and fourth edges of the bottom panel;

first and second side panels, each of said side panels having first and second elongated, opposed parallel side edges and third and fourth opposed parallel end edges, one of which is of a second predetermined length, and normal to the first and second edges of the side panel;

said first side panel being foldably joined at its first edge to the first edge of the bottom panel and folded upwardly to a disposition orthogonal to the bottom panel;

said second side panel being foldably joined at its first edge to the second edge of the bottom panel and folded upwardly to a disposition orthogonal to the bottom panel;

first and second rectangular outside end panels, each of said outside end panels having first and second, opposed parallel edges of the first predetermined length and third and fourth opposed parallel edges, one of which is of the second predetermined length, and normal to the last said first and second edges;

said first outside end panel being foldably joined at its first edge to the third edge of the bottom panel and disposed vertically with respect to said end panel;

said second outside end panel being foldably joined at its first edge to the fourth edge of the bottom panel and disposed vertically with respect to said end panel;

first and second rectangular inside end panels, each of said inside end panels having first and second, opposed parallel edges of the first predetermined length and third and fourth opposed parallel edges, one of which is of the second predetermined length, and normal to the last said first and second edges;

first and second bendable tab elements, each of said tab element being disposed along the second edges of the first and second inside end panels and being sized, shaped, and disposed to engage the tab element receiving slots of the bottom panel;

said first inside end panel being foldably joined at its first edge to the second edge of the first outside end panel;

said second inside end panel being foldably joined at its first edge to the second edge of the second outside end panel;

first, second, third and fourth rectangular end reinforcing panels, each of said end reinforcing panels having a pair of first and second elongated, opposed parallel edges two pair of which are of the second predetermined length, and third and fourth opposed parallel edges normal to the first and second edges;

each of said first and second end reinforcing panels being foldably joined at its first edge to one of the third edges of the first and second side panels and disposed orthogonally thereto;

each of said third and fourth end reinforcing panels being foldably joined at its first edges to one of the fourth edges of the first and second side panels and disposed orthogonally thereto;

each of said first and second rectangular inside end panels being disposed in face to face abutment with one of said first and second outside end panels, thereby enclosing and securing each of said first, second, third and fourth end reinforcing panels when each of the bendable tab elements is received in one of the tab element receiving slots of the bottom panel;

thereby forming an open topped bin of a rectangular base configuration with interlocked vertical side panels and end panels, said container having at least one movable, vertical divider;

each said divider being comprised of a center panel of a predetermined height not exceeding the second predetermined length and of a length not to exceed the first predetermined length, and a pair of rectangular end flaps, each of said end flaps being foldably joined to one of the ends of the center panel and disposed in slidable abutment with one of the first and second side panels; and whereby the divider may be slid along the inside of the length of the container and supported in any selected disposition to divide the bin into compartments of any desired volume thereof.

4. A one-piece, planar, paperboard blank for forming the paperboard bin claim 3.

5. A bin for storage and organization of piece parts and similar items, formed of a rigid paper material, said bin comprising:

a rectangular bottom panel, said bottom panel having first and second elongated, opposed parallel side edges and third and fourth opposed parallel end edges of a first predetermined length normal to the first and second edges;

first and second tab element receiving slots one being disposed along each of the third and fourth edges of the bottom panel;

first and second side panels, each of said side panels having first and second elongated, opposed parallel side edges and third and fourth opposed parallel end edges one of which is of a second predetermined normal to the first and second edges;

said first side panel being foldably joined at its first edge to the first edge of the bottom panel;

said second side panel being foldably joined at its first edge to the second edge of the bottom panel;

first and second rectangular outside end panels, each of said outside end panels having first and second, opposed parallel edges of the first predetermined length and third and fourth opposed parallel edges of the second predetermined length and normal to the last said first and second edges;

said first outside end panel being foldably joined at its first edge to the third edge of the bottom panel;

said second outside end panel being foldably joined at its first edge to the fourth edge of the bottom panel;

first and second rectangular inside end panels, each of said inside end panels having first and second, opposed parallel edges of the first predetermined length and third and fourth opposed parallel edges of the second predetermined length and normal to the last said first and second edges;

first and second bendable tab elements, said tab element being disposed along the second edges of the first and second inside end panels and being sized, shaped, and disposed to engage the tab element receiving slots of the bottom panel;

said first inside end panel being foldably joined at its first edge to the second edge of the first outside end panel;

said second inside end panel being foldably joined at its first edge to the second edge of the second outside end panel;

first, second, third and fourth rectangular end reinforcing panels, each of said end reinforcing panels having first and second elongated, opposed parallel edges of the second predetermined length and third and fourth opposed parallel edges normal to the first and second edges;

each of said first and second end reinforcing panels being foldably joined at its first edge to one of the third edges of the first and second side panels;

each of said third and fourth end reinforcing panels being foldably joined at its first edge to one of the fourth edges of the first and second side panels;

first and second detachable, rectangular divider panels, each of said divider panels having first and second elongated, opposed parallel edges and third and fourth opposed parallel edges normal to the first and second edges;

each of said first and second divider panels being detachably joined at its first edge to one of the second edges of the third and fourth end reinforcing panels by means of first and second perforations;

each of said first and second divider panels including a rectangular center section, said center section having first and second, opposed parallel edges of the first predetermined length and third and fourth opposed parallel edges of the second predetermined length normal to the first and second edges, and first and second rectangular end flaps;

each of said first and second end flaps having first and second, opposed parallel edges of the second predetermined length and third and fourth opposed parallel edges normal to the first and second edges;

each of said first and second end flaps being foldably joined at its first edge to one of the third and fourth edges of the center section of the first and second divider panels;

whereby, when the first and second divider panels are detached from the third and fourth end reinforcing panels and when the first, second, third and fourth end reinforcing panels are folded inwardly from the first and second side panels and the first and second side panels are folded inwardly from the bottom panel and the first and second outside end panels are folded inwardly from the bottom panel and the first and second inside end panels are folded inwardly from and over the first and second outside end panels to enclose the first, second, third and fourth end reinforcing panels and the first and second bendable tab elements are disposed to engage the first and second tab element receiving slots an open-topped bin may be formed; and whereby, when the first and second end flaps of the first and second divider panels are folded inwardly from the center section of the divider panels and the first and second dividers are inserted into the parts bin the first and second end flaps will be urged outwardly from the center section to bear against the first and second side panels of the parts bin, thereby providing up to three compartments within the parts bin of adjustable volume.

6. A paperboard bin for storage and organization of piece parts and similar items as described in claim 5, wherein:

said third and fourth edges of the first inside end panel and the first outside end panel have a third predetermined length, said length being less than the second predetermined length;

each of said first and second edges of the first and second end reinforcing panels are of the third predetermined length;

each of said third edge of the first and second side panels include a lower portion of the third predetermined length, said lower portion being parallel to the fourth edge and having a first end disposed at the first edge of one of the first and second side panels and an opposite second end, and an upper angled portion, said angled portion extending from the second end of the lower portion to a point along the second edge of one of the first and second side panels; and whereby, when the bin is formed, it will have a first end having a height equal to the second predetermined length and a second end having a height equal to the third predetermined length, thereby providing easy access to the parts bin.

7. A paperboard bin for storage and organization of piece parts and similar items as described in claim 5, wherein:

at least one of said first and second rectangular divider panels includes, said third perforation being spaced between the third edge and the fourth edge of the divider panel, thereby permitting the divider panel to be separated into two smaller divider panels of reduced height; and whereby, when the divider panel is separated into two smaller divider panels, the smaller panels may be used to more clearly display the contents of the bin.

8. A one-piece, planar, paperboard blank for forming the paperboard bin claim 5.

9. A one-piece, planar, paperboard blank for forming the paperboard bin claim 6.

10. A one-piece, planar, paperboard blank for forming the paperboard bin claim 7.

* * * * *